United States Patent [19]

Idec et al.

[11] Patent Number: 4,690,578

[45] Date of Patent: Sep. 1, 1987

[54] COSMETIC CONTAINER CONSTRUCTION

[75] Inventors: Eric J. Idec, Madison; Thomas F. Holloway, Southbury, both of Conn.

[73] Assignee: Risdon Corporation, Naugatuck, Conn.

[21] Appl. No.: 904,646

[22] Filed: Sep. 8, 1986

[51] Int. Cl.[4] ..... A45D 40/06; A45D 40/00

[52] U.S. Cl. ..... 401/78; 401/77

[58] Field of Search ..... 401/78, 77, 79, 80, 401/81

[56] References Cited

U.S. PATENT DOCUMENTS

| | | | |
|---|---|---|---|
| 2,629,488 | 2/1953 | See | 401/78 |
| 2,789,692 | 4/1957 | Ferri | 401/81 |
| 4,417,827 | 11/1983 | Kasai et al. | 401/78 |
| 4,514,102 | 4/1985 | Ackerman et al. | 401/78 |
| 4,603,989 | 4/1986 | Ackerman et al. | 401/78 |

FOREIGN PATENT DOCUMENTS

| | | | |
|---|---|---|---|
| 962791 | 7/1964 | United Kingdom | 401/78 |

*Primary Examiner*—John J. Wilson
*Assistant Examiner*—Michael Lynch
*Attorney, Agent, or Firm*—Hopgood, Calimafde, Kalil, Blaustein & Judlowe

[57] ABSTRACT

The invention contemplates a cosmetic-container of the propel-repel variety wherein all parts are assembled and retained by interference-fit and wherein metal-to-plastic interfaces characterize essentially all siding engagements. The arrangement is such as to provide a luxury "feel" through controlled drag torque (resistance) to relative rotation of the parts. And provision is made to positively retain any retracted position of the pomade carrier, whatever the remaining useful extent of involved pomade.

5 Claims, 7 Drawing Figures

COSMETIC CONTAINER CONSTRUCTION

BACKGROUND OF THE INVENTION

The invention relates to lipstick or the like containers of the so-called propel/repel variety wherein pomade substance mounted to a central carrier member is selectively displaced within the inner of two relatively rotatable tubular members, there being cam-follower means on the carrier member in continuous engagement with cam formations in the tubular members, for imparting such displacement.

In one period in the development of the art, such containers were all-metal. Clearances had to be observed and lubrication applied, to achieve smooth action. And with the more recent adoption of injection-molded plastic technology, the need for metal parts has all but disappeared. However, even with precisely formed plastic parts, the design technology has been somewhat influenced by the all-metal technology, to the extent that clearances must still be provided. Yet, regardless of the involved one or the other of these technologies, there has been a perceived need to provide clearances of such magnitude as to entail a degree of axial play in the retention of the tubular members to each other. Such play becomes aggravated as coacting plastic parts may shrink, and for this or other reasons there has been a lack of "silkiness" or quality "feel" in the operational handling of such containers.

Pat. 4,514,102 addresses the problem in a manner wherein a flanged collar has press-fitted permanent assembly to the upper one of two enlarged cylindrical base formations of the inner tubular member. The outer tubular member is formed with a plastic radial flange which is axially sandwiched between the flange of the collar and a shoulder of the inner tubular member, with a degree of axial preload whereby axial play is avoided.

One of the limitations of the patented conssruction is that, for a given capacity of dispensable pomade substance, there is an excessive dedication of overall length to the base end of the inner tubular member, because both the collar and a base cup must be fitted in axially abutting relation and with independent force-fit engagements to the base end of the inner tubular member, meaning that the combined length of the collar and of the base cup must be below the lower end of the propulsion-cam region of the container.

BRIEF STATEMENT OF THE INVENTION

It is an object of the invention to provide an improved lipstick-container construction, wherein properties of plastic parts and of metal parts are optimized for superior action in the final product.

A specific object is to provide such a construction wherein axial play is at a minimum.

Another specific object is to provide a construction meeting the above objects and inherently characterized by predetermined, controlled, smooth and uniform torsional friction or drag, in the course of rotary actuation.

Another specific object is to provide a new basic internal arrangement of components to achieve the above objects, while also lending itself to adoption and use of a variety of external or finish design appearances, as may be variously desired to accommodate the different style requirements of different cosmetic-house customers.

A further specific object is to meet the above objects with a construction in which the overall length-dedication requirement attributable to base of the inner tubular member is materially reduced, thus materially increasing the proportional share of container volume available for pomade loading.

The invention achieves the foregoing object in a construction in which the base cup is the only part that is force-fitted to the base of the inner tubular member. The base cup is substantially longer than the base of the inner tubular member, so that when the force-fit engagement to the base of the inner tubular member is deep, the open end of the base cup spans and extends beyond the plastic flange of the sleeve. A tubular metal adapter member integrally includes a radially inward flange which has preloading engagement to the upper surface of the plastic flange, when the skirt of the base cup is in metal-to-metal force-fitted assembly to the lower end of the adapter member. Thus, circumferentially continuous metal-to-plastic engagement characterizes the positioning fit to both surfaces of the sleeve flange. In general, the fitted parts requiring relative motion intentionally involve metal-to-plastic engagement, and the fitted parts requiring no relative motion are force-fitted, with metal-to-metal engagement.

DETAILED DESCRIPTION

A preferred embodiment of the invention will be described in detail, in conjunction with the accompanying drawings, in which.

Figure 1:
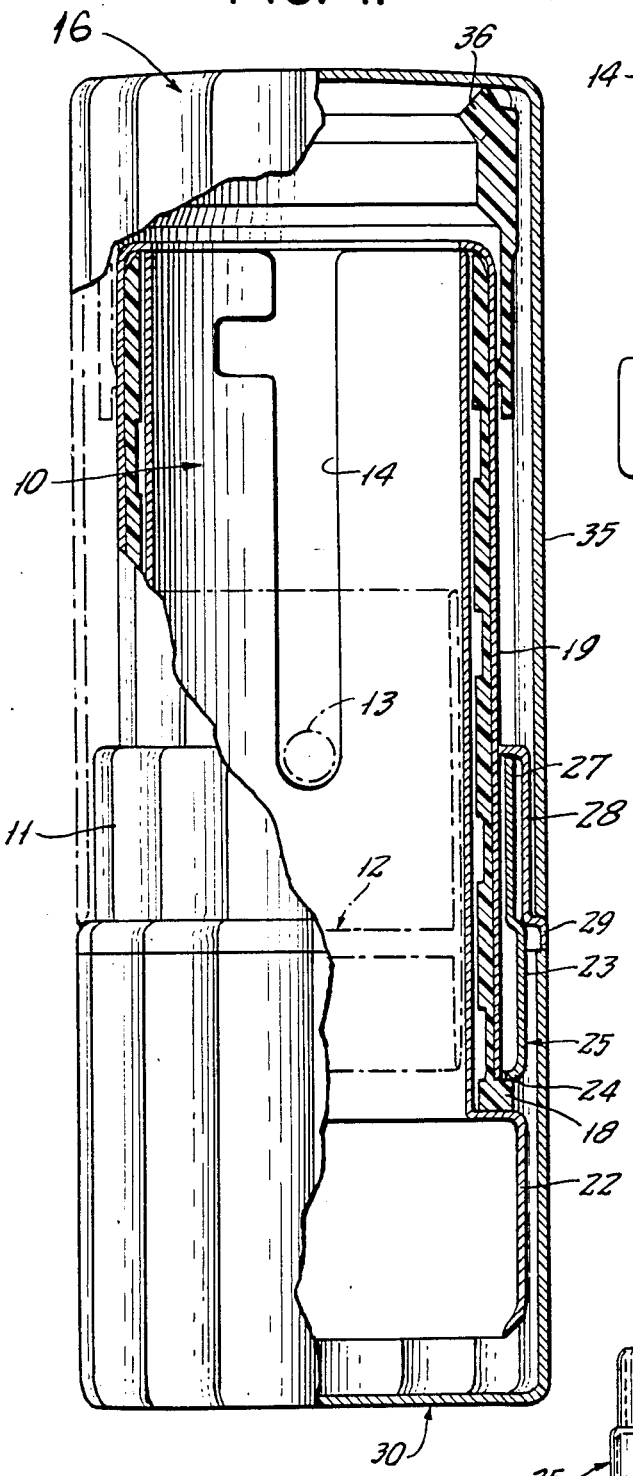
FIG. 1 is an enlarged view in elevation of a container of the invention, partly broken-away and in longitudinal section to reveal internal relationships.
Figure 2:
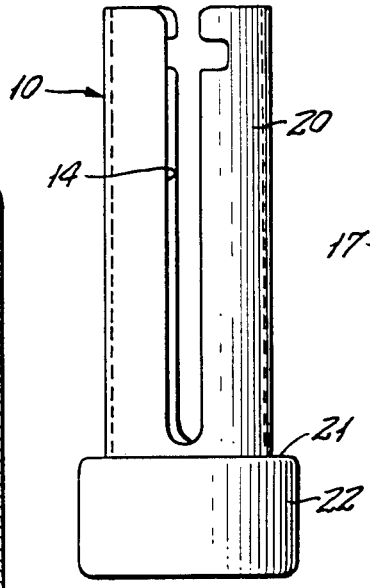
FIG. 2 is a side view in elevation of the inner tubular member part of the container of FIG. 1.

Referring initially to FIG. 1, a container of the invention is seen to comprise relatively rotatable inner and outer tubular members 10-11, and a carrier member 12 is guided within inner tubular member 10 for selective elevation of pomade (not shown) with respect to the open upper end of members 10-11. Propulsion of carrier member 12 relies upon cam-follower means 13 on the carrier member, extending radially for concurrent engagement with a straight cam slot 14 in inner tubular member 10 and a spiral cam groove 15 in outer tubular member 11. In the preferred arrangement, follower 13 is in duplicate projecting in diametrically opposite outward directions, and the straight and spiral cams 14-15 are also in duplicate, concurrently engaging the respective followers at locations 180-degrees apart, with respect to the central longitudinal axis of the container. A removable closure cap 16 is friction-retained to the outer tubular member 11, with anti-rotational keyed engagement to the inner tubular member 10, as will be later explained.

In accordance with the invention, a material shortening of overall length requirements is achieved for a container of given pomade capacity, all without sacrifice of the all-important feature of said patent, namely, the provision of a predetermined low level of smooth, circumferentially continuous torsional friction which characterizes relative rotation of members 10-11, and their action is free of axial play. The precision-fitted parts which achieve this result comprise a plastic sleeve part 17 of the outer tubular member 11, the inner tubular member 10, a base cup 30, and a tubular metal adapter member 25.

Figure 3:
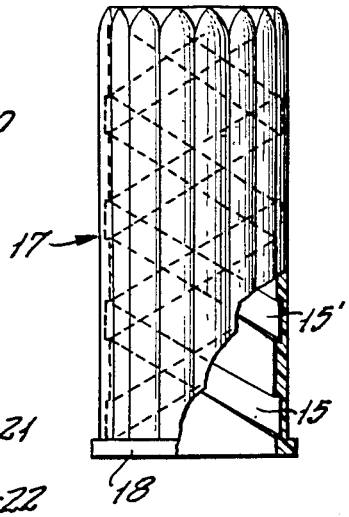
FIG. 3 is a partly broken-away view in elevation of the outer tubular member part of said container.

More specifically, sleeve 17 may be injection-molded of medium-impact styrene. As best seen in FIG. 3, sleeve 17 is basically straight-cylindrical, with its bore characterized by two spiral cams 15-15' at 180° phase offset. These grooves terminate short of the upper end of sleeve 17 and they are open at the lower end, for assembly acceptance of the two cam followers via the lower end of the sleeve. A radially outward flange 18 is an integral formation with the lower end of sleeve 17. The outer surface of sleeve 17 may be cylindrical but is seen in FIG. 3 to be characterized by plural longitudinal flutings adapted for press-fitted assembly to corresponding flutings of an outer decorative metal shell 19, to accord with a customer's taste as to external appearance.

The inner tubular member 10 comprises a formed metal tube having an elongate upper cylindrical propulsion-cam portion 20 (with straight cams 14) having running clearance with the bore of sleeve 17. A radially outward shoulder 21 integrally connects a cylindrical base portion 22 to the upper portion 20 and defines a flat radial annulus of shoulder support for the flanged lower end of the plastic sleeve 17. The base portion 22 is relatively short and is to an outer diameter which is slightly in excess of the outer diameter of sleeve flange 18.

The adapter member 25 is characterized (1) by a lower cylindrical portion 23 having a bore which radially clears sleeve 17 and its shell 19 but which is of outer diameter matching that of the base portion 22 of the inner tubular member and hence, slightly greater than the diameter of the plastic sleeve flange 18, and (2) by a lower radially inward flange 24 which axially engages the upper surface of sleeve flange 18.

The base cup 30 is of formed metal, with a bore sized for metal-to-metal force-fitted permanent assembly both to the base 22 of the inner tubular member and to the lower cylindrical end 23 of the adapter member 25. As shown, base cup 30 has a longitudinal skirt that is characterized by flutings consistent with the pattern of flutings of the outer tubular member 11. That being the case, the bore of the skirt of base cup 30 is effectively the circular locus of inward cusps attributable to the flutings, and it is this locus which has interference fit with base portion 22 and with the lower cylindrical surface 23 of adapter 25. In FIG. 1, it is seen that base portion 22 is thus fitted deep into the bore of base cup 30 and that the lower cylindrical end 23 of adapter 25 is substantially lapped by the skirt of cup 30. By this arrangement, the base cup 30 has substantial length for assurance of container actuating grasp, well beyond the base level of pomade support in carrier 12, when retracted; and increased usable pomade-accommodating space in the container extends well down into the depths of cup 30.

The adapter member 25 extends axially beyond the upper cylindrical end 27 of base cup 30 and may be shaped for seating engagement by the closure cap 16. However, in the form shown, the upper end 27 is of slightly reduced diameter, as compared with that of the lower end 23, to enable force-fitted application of a metal collar 28 over the cylindrical end 27. To accord with the customer's choice of external appearance, collar 28 is characterized by the indicated elongate-flute pattern, and it is via the corresponding inward ribs of the flute pattern that collar 28 is press-fitted to the upper end 27 of the adapter. For appearance purposes, the upper end of collar 28 has a radially inward flange which caps the upper end of adapter 25, and for closure-cap seating purposes, the lower end of collar 28 has a short outward shoulder and axial lip 29, which in the form shown matches the external design contour of the base cup 30.

It will be seen that the radially inward adapter flange 24 may be the means for not only axially retaining sleeve 17 via its flange 18, but also for applying a circumferentially continuous and uniform predetermined level of light axial squeezing preload of the radial metal surfaces 21–24 against the sleeve flange 18. By reason of the metal-to-plastic engagements of the relatively rotatable elements, in the context of low-friction properties of the involved plastic material, the smoothness of rotational action is analogous to that of said patent and is in complete contrast to the action of prior constructions, and the engagements are effectively self-lubricating.

Figure 5:
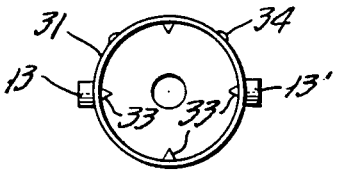
FIGS. 4 and 5 are, respectively, side and top views of the carrier member of the FIG. 1 container.
Figure 4:
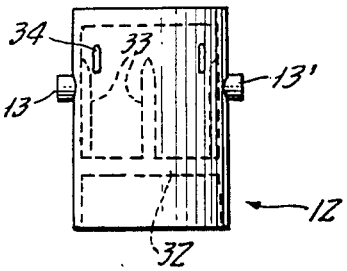
Figure 6:
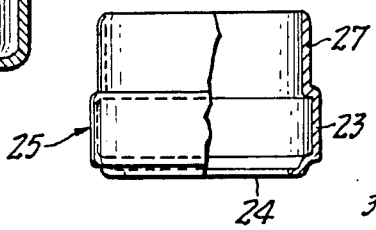
FIG. 6 is a longitudinal sectional view of an adapter member in the structure of FIG. 1.
Figure 7:
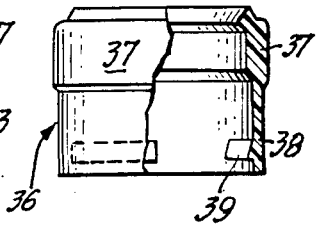
FIG. 7 is a partly broken-away view in elevation of a part of the closure cap of the FIG. 1 container.

Remaining parts of the container may be as described in said patent, to which reference is made for detail. Thus, as seen in FIGS. 4 and 5, carrier member 12 may be a single piece of injection molded plastic, comprising a thin cylindrical shell 31 with a pomade platform near its lower end. Inwardly directed ribs 33 stabilize pomade engagement, and outward ribs 34 have stabilizing continuous contact with the base of inner tubular member 10.

The closure cap 16 may be a formed metal shell 35 with external flutings which have anti-rotational mesh with flutings of collar 28, when seated against the shoulder of collar 28. For friction retention of the closure cap, a special insert 36 of molded plastic has yieldable engagement to the upper end of shell 19.

The described construction will be seen to meet all stated objects, providing a quality "feel" through use of metal-to-plastic engagements wherever relative motion is involved; the only exception to this is that the cam followers are of plastic and engage the spiral cam grooves 15-15' of the sleeve 17 of the outer tubular member. Interference fits characterize the assembly of parts, there being a permanent force-fit for any parts not involved in relative motion, and where a predetermined torsional drag friction is important, the force-fitted parts are metal-to-metal. Placement of the closure cap 16 locks the same, in the illustrative case via key-engaged flutings, to the inner tubular member, thus exposing no access to the outer tubular member 11 as long as the cap 16 is in place. Furthermore, the frictional engagement between cap insert 36 and the inner tubular member (at shell 19) provides assurance against vibrational displacement of a loaded carrier in a closed container, in the course of shipping and handling. The described torsional drag attributable to a controlled axial squeeze of plastic flange 18 between two radial-plane metal formations (21–24) will be seen as an advantage to the user, particularly as the cosmetic substance becomes more consumed, in that retraction of pomade back into the container need not be retraction to the bottom of the actuating cams, and the described keying (to the inner tubular member 10) and rotational braking (to the outer tubular member 11) will be seen to be effective whatever the carrier position when pomade is deemed to be adequately retracted.

In addition, for a given size container, there is a substantial increase in volumetric capacity for pomade stored therein.

While the invention has been described in detail for a preferred form, it will be understood that modifications may be made without departing from the scope of the invention.

What is claimed is:

1. In a swivel lipstick or the like container having an open end for the dispensing of cosmetic substance, wherein a central carrier member of the container has a cam follower engaged to propulsion cams of inner and outer tubular members which are relatively rotatable to develop propel/repel displacement of the carrier member with respect to the open end of the container, and wherein a closure cap is removably applicable over the open end and in longitudinal overlap of the propulsion-cam region of the container with friction engagement to one of said tubular members, the improvement wherein the inner tubular member is of metal and is characterized by a radially outward shoulder formation between an elongate upper propulsion-cam portion of lesser diameter and a circumferentially continuous cylindrical base portion of greater diameter, wherein the outer tubular member includes a sleeve of molded plastic with an elongate cam-characterized bore in running clearance with the upper portion of said inner tubular member, and wherein the outer tubular member integrally includes a circumferentially continuous radially outward flange in axial engagement with said shoulder formation and of diameter less than said greater diameter, a circumferentially continuous tubular metal adapter member with a lower cylindrical portion having an outer diameter equal to said greater diameter, said adapter member including at its lower end a radially inward flange in axially abutting relation with the upper surface of said outer tubular member, and a base cup member having a bore of greater axial extent than the base of said inner tubular member and in permanent metal-to-metal force-fitted assembly to both said greater-diameter cylindrical surfaces, namely to the base of said inner tubular member and to at least the lower end of said adapter member, said force-fitted assembly being characterized by axial engagement of said adapter flange and of said shoulder to the respective upper and lower surfaces of said plastic sleeve flange.

2. The improvement of claim 1, in which the plastic of said sleeve is of relatively low-friction coefficient, and in which the force-fit of said adapter member axially loads the inward flange of said adapter member and said shoulder formation to a predetermined extent of compressional engagement to said sleeve flange, thereby eliminating axial play between said tubular members and producing a controlled degree of torsional resistance to relative rotation of said tubular members.

3. The improvement of claim 1, in which closure-cap seating means at the upper end of said adapter member is poised for detachable seating reception of the closure cap.

4. The improvement of claim 3, in which said closure-cap seating means comprises a metal collar force-fitted to the upper end of said adapter member and having external axially extending fluting formations, and in which said closure cap integrally includes inward fluting formations engaged to collar flutings when in seated position.

5. The improvement of claim 1, in which said base cup member is integrally formed with internal flutings via which both force-fitted engagements are made.

* * * * *